United States Patent [19]

Šorm et al.

[11] Patent Number: 4,503,996

[45] Date of Patent: Mar. 12, 1985

[54] LIQUID ATOMIZER HAVING A DOUBLE-ACTING PUMP

[75] Inventors: Miloslav Šorm, Prague; Josef Langpaul, Otrokovice; Karel Ulbert, Prague; Karel Kadlec, Uhersk Brod; Stanislav Skalick , Prague; Miroslav Brázdil, Bilovice; Stanislav Nešpůrek, Prague; Jaromír Kenša, Gottwaldov; Miroslav Zvoníček, Prague; Zdeněk Hrdina, Hluk, all of Czechoslovakia

[73] Assignee: Ceskoslovenska akademie ved, Prague, Czechoslovakia

[21] Appl. No.: 450,213

[22] Filed: Dec. 16, 1982

[30] Foreign Application Priority Data

Dec. 16, 1981 [CS] Czechoslovakia ..... 9373-81

[51] Int. Cl.[3] ..... B05B 11/02

[52] U.S. Cl. ..... 222/321; 222/385

[58] Field of Search ..... 222/321, 320, 383–385, 222/372, 373, 380, 340, 341; 239/333, 331; 417/541

[56] References Cited

U.S. PATENT DOCUMENTS

| | | | |
|---|---|---|---|
| 3,967,762 | 7/1976 | Machon | 222/321 |
| 4,140,249 | 2/1979 | Majima | 222/321 |
| 4,174,790 | 11/1979 | Nozawa et al. | 222/321 |
| 4,317,531 | 3/1982 | Saito et al. | 222/380 X |
| 4,325,501 | 4/1982 | Shay | 222/321 |

*Primary Examiner*—Stanley H. Tollberg

[57] ABSTRACT

Liquid atomizer having a reciprocable pump. The atomizer provides a reliable sealing of the piston rod of the pump with lowered requirements as to the manufacturing tolerances of parts, a simplified manner of venting, and the sealing of the atomizer against leakage when the atomizer is placed in any arbitrary rest position. A sleeve having a smaller inner diameter than the cylinder is mounted on the upper part of the cylinder of the pump and its upper part is in contact with the inner part of a neck of a housing for the atomizer. A free space between the inner wall of the housing and the outer wall of the cylinder of the pump is connected below with the interior of the bottle on which the atomizer is mounted, and the upper part of the free space communicates with the surface of a tube by radial channels passing through the sleeve of the cylinder. The tube slidingly passes through the neck of the housing, is connected on the top with an operating button, and ends below with a sealing cuff piston which covers, when in its upper position, the radial channels and, at the same time, bears by its upper part on the neck of the housing. The tube forms a part of a narrow upper part of a piston rod which reciprocates through the sleeve, whereas the lower broadened part of the piston rod bears the piston of the pump and a one-way valve.

10 Claims, 4 Drawing Figures

LIQUID ATOMIZER HAVING A DOUBLE-ACTING PUMP

Figure 1:
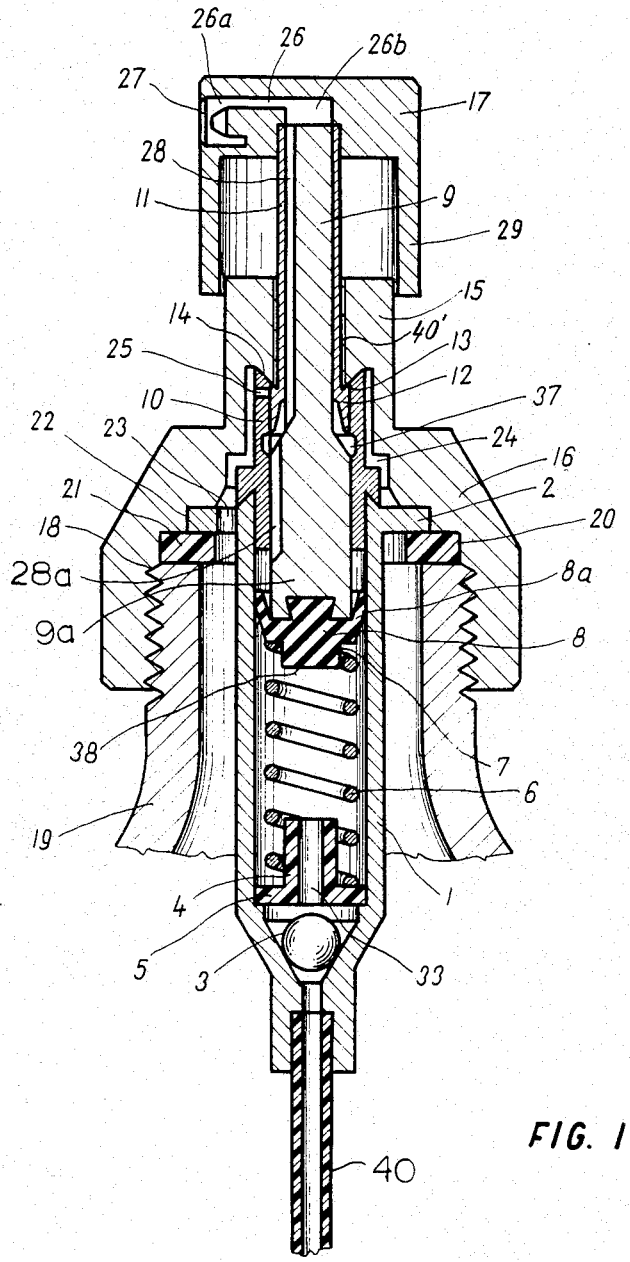

This invention relates to a liquid atomizer having a mechanical pump. In some preferred embodiments of the invention the pump is double-acting, but in its broader aspects the invention is not limited thereto. Such atomizer is suitable for the spraying of lacquers, dyes, insecticides, cosmetics, cleaning agents, antistatic agents, and the like. The atomizer operates with a bottle for liquids, such bottle communicating with the outer atmosphere; the fundamental parts of the atomizer may be manufactured by plastic materials.

Among the advantages of the double-acting mechanical atomizer for liquids of the invention, which is designed to replace present atomizers employing liquid or gaseous propellants, are the fact that it does not need pressure vessels, is reusable so that it may be employed for the spraying of several charges, and, in contradistinction to single-acting mechanical atomizers presently in use, it provides a virtually continuous cloud of atomized liquid, thus making its use more effective and its handling easier.

The problems with double-acting mechanical pumps hitherto known and used are the provision of a reliable sealing of the piston rod, because liquid also occurs in the space above the piston, the provision of a reliable connection of a liquid bottle with the outer atmosphere during operation, and also the prevention of liquid leakage if the bottle with the pump is placed with the pump other than upright with the pump on top, such as in a horizontal position or even an inverted position.

In Czechoslovak patent application No. PV 2100-81, wherein a static sealing of a piston rod is used, the atomizer has an operating cylinder inserted into a liquid bottle. The lower part of the operating cylinder contains a one-way valve, and the upper part of the operating cylinder is provided with a flange bearing on the neck of the liquid bottle. The static sealing fits on the upper surface of the flange and also has the shape of a flange with a central hole larger than that through which the piston rod passes. Therefore the hole has sealing projections in its upper and lower parts. The piston rod is furnished, at its lower end in the operation cylinder, with an operation piston containing a one-way valve, either a ball valve or a cup valve if a cup piston is used.

The piston rod is kept in its elevated position by a spring disposed on the upper face of the static sealing and bearing at its upper end against an operating button mounted on the piston rod. The operating button contains a nozzle which communicates through a longitudinal channel in the piston rod with the space above the cup piston. A venting channel passes through the flange of the operation cylinder to the static sealing, where it links to a free space around the piston rod and leaves off above the sealing in the bottom of the operation button, where it is sealed in the rest position by a ring packing which is thrust into sealing position by the spring. This construction is suitable for precise atomizers constructed for many repeated charges. The above design is too complex for a cheap mass production, wherein a small number of parts and low requirements of manufacturing tolerances for twice or three times repeated charging of the atomizer represent the oridinary course of its use.

The present invention has among its objects the provision of a reliable sealing of the piston rod with lower requirements as to dimensional tolerances of the various parts, a simplified manner of venting and sealing against leakage even though the atomizer may be disposed in various positions other than an erect position, such construction being characterized by its reduced number of parts, as well as the pumping of equal amounts of atomized liquid in both directions of piston travel by a mere modification of the common parts of the pump in accordance with the invention. Such setting is necessary with pumps of the prior art in a series of modified types of the atomizer for various amounts of sprayed liquid per pump cycle, which is attained by changing the piston stroke, and with various characters of the cloud of atomized liquid which are attained by replacement of the nozzle.

The above-mentioned shortcomings of prior known designs are overcome, with respect to a cheap mass production, in the liquid atomizer provided with a double-acting mechanical pump in accordance with the invention. Such pump has an operation cylinder, provided on the top with the flange for contact with the bottle, and, in the lowest part, with a one-way valve. The atomizer is further provided with a one-way valve in the operation cylinder, which is fitted on a piston rod passing through the neck of a sleeve, the said piston rod ending on its top with an operation button having a nozzle permanently connected with the space above the operating piston through a longitudinal channel. The said piston is operated in one direction by a spring, an insert with a smaller inner diameter being placed in the upper part of the operation cylinder, such insert is in contact with the inner part of the neck of the sleeve by its upper part which overlaps the flange of the operation cylinder. The free space between the inner wall of the sleeve and the outer wall of the operation cylinder is connected below to the bottle by axial channels passing through the flange and a packing, and, in the upper part, is connected with the surface of a tube, which slidingly passes through the neck, by means of radial channels passing through the insert of the operation cylinder. The said tube, connected at its upper end with the operation button, ends below with a sealing cuff piston, which, in its upper position, covers the radial channels, and bears at the same time by its upper part on the neck. The said tube is slid on the narrower part of the piston rod, the lower broadened part of which, with the operating piston and the one-way valve, is slidingly mounted in the insert of the operation cylinder. In one embodiment of the atomizer, the operation cylinder is provided with a ball of a one-way valve disposed in its lower broadened part and provided with a cage above the ball formed by the flange and a tube, whereas a connecting hole is provided through this tube so as to connect the space above the ball with the space above the cage, the flange and the bottom of the operation piston being provided with bearing surfaces for the spring.

In a further disclosed embodiment of the atomizer, the operation cylinder contains in its lower broadened part a cage formed by the flange and the tube, whereas a conical cuff pointing upwardly is slid on this tube; the connecting hole connects the space below the cage and the space below the upper edge of the conical cuff; recesses for the spring are provided in the outer face of the neck and the bottom of the operation button.

The operation cylinder can also be made in such a way that the insert, made as an independent element, is slid into the upper part of the operation cylinder.

An improved atomizing is attained, if recesses are formed in the inner wall of the insert of the operation cylinder, when the piston is in its upper dead center position.

The one-way valve may also be formed on the operation piston by fitting the operation piston on the lower end of the broader part of the piston rod with the cuff pointing upwardly. The longitudinal channel for the permanent connection of the nozzle with the space above the operation piston may be advantageously formed on the surface of the piston rod.

An advantage of the double-acting mechanical atomizer according to the invention consists in the kinematic seal used for sealing the piston rod, which is formed by the sealing cuff piston fitted on the piston rod. This sealing possesses wide manufacturing tolerances, and exhibits low friction.

Another advantage is the simple design of the manner of venting the atomizer, combined with high efficiency. This high efficiency, above all, flows from the fact that the piston rod passes with a certain small play through the neck of the outer body. This play is sufficient to provide for the passage of equalizing air, but represents a considerable resistance against the flowing of a liquid therethrough, such liquid having easier ways of returning to the bottle proper. Provided that a minute amount of liquid is even passed into the space within the neck, this is immediately directed to return to the bottle proper by the under-pressure which arises in the liquid bottle at every pushing and release of the operation button.

A further advantage of the atomizer of the invention is the omission of a sealing ring at the venting hole closure. The wedge shape of the outer part of an auxiliary sealing cuff piston and of the upper part of the neck provides a reliable closure under the considerable pressure exerted by the operating spring. Another benefit is the advantageous formation of the inlet channel to the nozzle by the cutting-off of the side of the piston rod.

A still further advantage is the simple variation of the amount of liquid delivered in one spray by varying the height of the cage, whereas the volume of the cage allows making the required correction to achieve equal amounts of sprays in both directions of operation of the piston. The same effect may be obtained by shaping the step in the bottom of the operation piston or in both elements. In this way, a series of atomizers for various purposes may be created from the same basic design. The correction to attain equal volumes of spray is necessary, particularly if the characteristics of the spray nozzle are changed.

Figure 2:
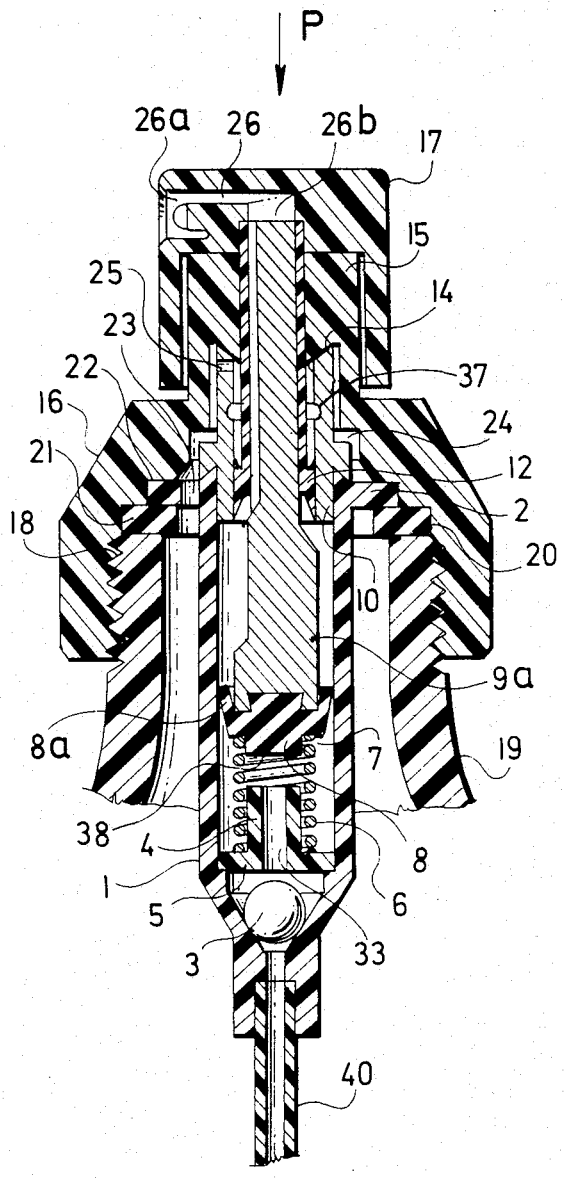

The invention will be more readily understood upon consideration of the accompanying drawings, wherein:

FIG. 1 is a fragmentary view in vertical axial section through a first preferred embodiment of the atomizer of the invention with the piston of the pump in its upper terminal position, the spray nozzle being incorporated in the operation button, the operation piston being of the cuff type, which acts as a valve at the same time, the spring which acts upon the piston being disposed within the operation cylinder;

FIG. 2 is a view similar to FIG. 1 of the first embodiment of the atomizer but with the piston of the pump in its lower terminal position.

Figure 3:
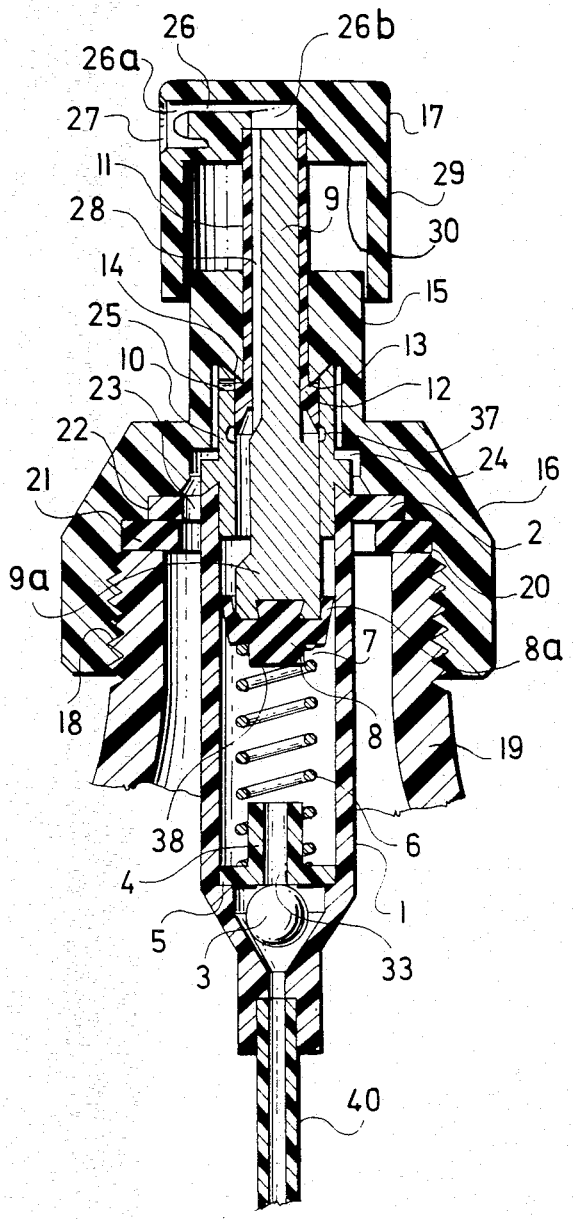
Figure 4:
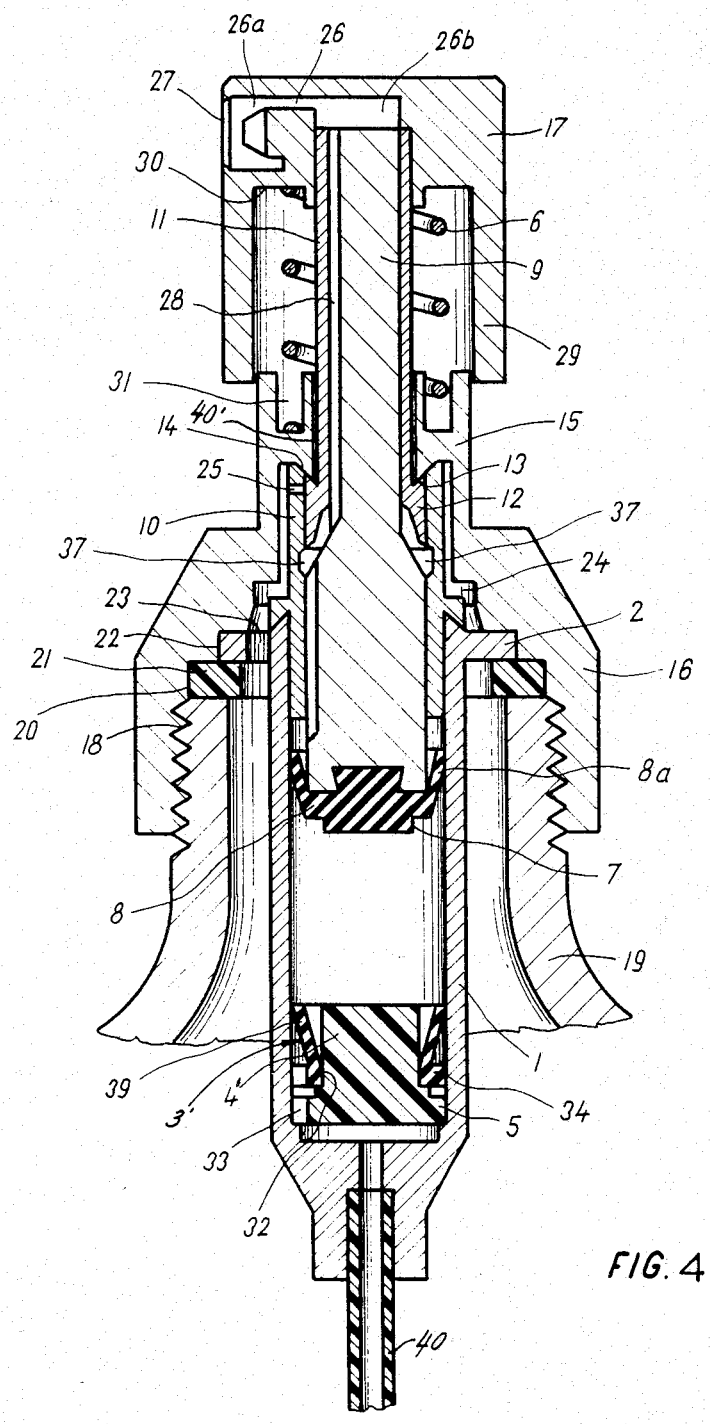

FIG. 3 is a view similar to FIG. 1 of the first embodiment of the atomizer but with the piston in an intermediate position; and FIG. 4 is a view similar to FIG. 1 of a second preferred embodiment of the atomizer of the invention, the spring which acts upon the piston being disposed outside the cylinder, and the one-way valve in the bottom of the cylinder being of the cuff type rather than the ball type in the embodiment of FIG. 1.

Turning first to FIG. 1, the liquid atomizer thereshown has an operation cylinder 1 provided at its top with a flange 2 the lower surface of which abuts the upper surface of the neck of a bottle 19 in which the atomizer is mounted. The lower part of the cylinder 1 receives the operation piston 8, and insert 10 having an inner diameter less than that of cylinder 1, being disposed on the upper end of cylinder 1 and serving as a guide for the lower, larger-diametered part 9*a* of the piston rod 9. The insert 10 has upper and lower portions which lie above and below, respectively, the flange 2. The cylinder 1 and the insert 10 may, if desired, be manufactured either as an integral part or as separate elements, as shown.

A one-way valve, in this case the valve having a ball 3, for the inlet of the liquid in bottle 19 into the space within the operation cylinder 1, is placed in the lower, wider part of the cylinder 1. The lower, wider part of the cylinder 1 further accomodates a cage 4 of tubular form, the tube terminating at its lower end in a flange 5 which is disposed in a seat provided in the bottom of the cylinder 1. The cage 4 forms a part of the one-way valve, and serves, at the same time, for the correction of the amount of liquid sprayed, or for adjusting the spray so that they are equal in both directions of piston travel.

Such correction is brought about by enlarging or reducing the volume of the bottom part 38 of the piston 8. The piston 8 is of the cuff type, the cuff 8*a* thereof serving, at the same time, as an element for the one-way flow of liquid into the space above the piston 8. The piston 8 is fixed into the piston rod 9, the large diameter part 9*a* of which is disposed slidingly in the insert 10 in the upper end of the cylinder 1. The narrower upper part of piston rod 9 is firmly fixed in a tube 11, the lower end of which is provided with obturator in the form of a sealing cuff piston 12, the lower part of cuff piston 12 determining the minimum length of the narrower part of the piston rod 9. At the same time, four recesses 37, equally angularly spaced about the vertical axis of the piston rod, are provided in the inner wall of the insert 10 below the lower end of the cuff piston 12. The recesses 37 may have a circular or oval profile, and four recesses 37, spaced from each other by 90 degrees, constitutes a sufficient number thereof. Recesses 37 selectively communicate both with the lower end of the longitudinal upper channel 28, as well as the shorter longitudinal lower channel 28*a* in larger diameter part 9*a* of the piston 8.

The upper edge of the cuff piston 12 terminates in a wedge-shaped projection 13, which is complementary with respect to the surface 14 on the lower inner part of the neck 15 of the sleeve 16, surfaces 13 and 14 being of downwardly and inwardly converging shape. The outer side of the neck 15 forms a guideway for the tubular adapter or skirt 29 of the operation button 17 affixed to the upper end of the piston rod. The sleeve 16 has a downwardly extending inwardly threaded skirt which threadedly engages the threads 18 on the outer surface of the neck of the bottle 19. A recess 20 accomodating a ring packing 21, and a recess 22 for the flange 2 of the cylinder 1, which is disposed in liquid-tight relationship in the recess 22, are disposed above the threaded recess in the sleeve 16. The flange 2 contains, adjacent the outer jacket of the cylinder 1, one or more axially extending channels 23 for the venting of and return of the leaking fluid into the bottle 19 proper.

The free space 24, connected to this axial channel 23, is created e.g. in the outer body or sleeve 16 by a rotationally symmetrical recess adapted by its shape to the outer shape of the insert 10 of the cylinder 1 above the flange 2. The distance between confronting walls of this free space 24 may range from 0.3 to 5 mm. The upper part of the free space 24 is terminated by the earlier-mentioned varying surface 14 which, on the one hand, bears on the upper end of the sealing cuff piston 12, and on the other hand bears on the upper part of the insert 10 of the cylinder 1. This upper end of the insert 10 is furnished with one or more radial channels 25 the diameter of which is less than the length of the cuff piston 12 connected to the lower end of tube 11. The said tube 11 passes through the neck 15 of the sleeve 16 with a play or gap 40 ranging from 0.05 to 0.15 mm. The operation button 17 is mounted on the upper part of the tube 11, and the cavity 26 is formed in its upper part, with a radially directed passage which leads the pumped liquid into the nozzle 27 in the operation button 17.

The cavity 26 consists of a distribution part **26*a*, carrying on its outer edge the said nozzle 27, and a collection part 26*b* joined with the longitudinal channel 28 formed in the body of the piston rod 9, preferably as a groove in its outer surface, as shown. This longitudinal channel 28 leads below, near the piston 8, into the space above the piston 8. As above set forth, the operation button 17 is provided in its lower part with a tubular skirt 29; the length of skirt 29 is approximately the same as the length of the neck 15, i.e., about 1 to 5 mm longer than the length of travel of the piston 8. The inner diameter of the tubular adapter 29 is larger by 0.1 to 0.5 mm than the diameter of the neck 15. The atomizer is completed by a dip tube 40 which is sealingly connected to the bottom of the operation cylinder 1. When the interior of cylinder 1 is subjected to reduced pressure, the ball 3 of the valve rises from its seat as shown in FIG. 3 and liquid flows upwardly through the dip tube 40 past the ball valve and into the interior of the operation cylinder 1** above such valve.

Turning to FIG. 4, there is shown a second preferred embodiment of the atomizer in accordance with the invention. Parts in FIG. 4 which are the same as or similar to those in the embodiment of FIGS. 1, 2 and 3 are designated by the same reference characters. The embodiment of FIG. 4 differs from that of FIGS. 1, 2 and 3 among other respects, by the fact that the spring 6' is disposed in the upper part of the atomizer, exterially of the upper end of the piston rod 9' of the piston, rather than beneath the piston 8 and within the lower end of the cylinder 1. In FIG. 4 the spring 6' bears at one end on the upper end of a recess 30 in the bottom of the operation button 17, and at its other, lower end on the bottom of the recess 31 formed in the neck 15 of the sleeve 16. The cage 4, and the lower wider part **9*a* of the cylinder 1 in FIG. 4, carries a one-way valve 3' which has a conical cuff 34 placed by a footing flange 39 at its lower end on a circular step 32 and bearing at its upper, larger diameter on the inner wall of the cylinder 1. A connecting hole 33 is provided in the flange 5 and the footing flange 34, so as to lead the liquid from the bottle 19 upwardly through the dip tube 40 into the space in the cylinder 1 beneath the piston 8 through the valve 3', which is open when the space within the cylinder 1 is subjected to sub-atmospheric pressure by the rising of such piston 8**.

It will be seen that the cuff piston 12 travels with and functions as a part of the piston rod 9'. Cuff piston 12 acts as a reciprocable inner valve element which cooperates with the insert 10, which functions as an outer valve body. The outer valve body has two axially spaced sets of ports, the lower recesses 37 and the radial channels 25. The axial length of the valve element part of the cuff piston 12 is such that when it fully covers radial channels 25, recesses 37 are uncovered, as shown in FIG. 1.

MANNER OF OPERATION OF THE ATOMIZERS OF FIGS. 1 and 4

The atomizers of both FIGS. 1 and 4 are operated by pushing the operation button 17 downwardly by a force P (FIG. 2), which shifts the sealing cuff piston 12 and the piston 8 from their upper terminal position (FIGS. 1 and 4) into their lower terminal positions (FIG. 2). Then, after releasing the operation button 17, the spring 6 respectively 6' elevates the piston 8 and the cuff piston 12 toward the upper position (FIGS. 1 and 4), and the liquid in the bottle is sucked into the wider part of the operation cylinder 1 as the piston 8 rises therein. Another pushing downwardly of the operation button 17 presses the liquid around the cuff **8*a* above the operation piston 8. The piston 8 is displaced upwardly after the operation button 17 is again released, and presses the liquid accumulated above the operation piston 8 upwardly to the nozzle 27 through the longitudinal channel 28. Immediately before the cuff piston 12 achieves its upper position, when it is in the intermediate position shown in FIG. 3, its lower end uncovers the recesses 37 permitting fluid under pressure to flow into them, and thus causing a rapid drop of the pressure in the longitudinal channel 28. Thus the spray from nozzle 27** is terminated without the formation of larger drops, so that the fineness of atomization remains the same.

Again pushing the operation button 17 downwardly so that pump piston 8 and cuff piston 12 occupy the positions thereof shown in FIG. 3 or below such positions, the upper edge of the cuff piston 12 covers the radial channels 25, which lead to the surface of tube 11 and are connected with bottle 19 through the cavity 24 and the axial channels 23. Sub-atmospheric pressure in the bottle 19 may suck a minute amount of liquid which could pass above the sealing cuff piston 12. At the same time, venting air is sucked through the said radial channels 25, such venting air passing through the gap 40' (the play) between the tube 11 and the neck 15 in a sufficient amount. This play is enough for the passage of venting air, but represents a considerable resistance to the passage of liquid which could leak by chance, and which therefore returns into the bottle 19 more easily in other manners. The amount of liquid atomized by each stroke of the operation piston 8 may be varied by changing the volume occupied by the bottom 38 of the piston 8 and the volume of the cage 4. The bottom 38 of the operation piston 8 can be either elevated or lowered, or a cavity can be made in it. The tube of the cage 4 may also be elevated or lowered, and the diameter of the axial connecting hole 33 may be changed. The required correction can be attained in this way to produce equal spraying in both directions of travel of the piston 8. A series of atomizers for various purposes can be readily created in this way from the same basic design. The correction of the atomizer for equal spray is needed, in particular, when the characteristics of the nozzle 27 are changed.

Atomizers of liquids with a double-acting mechanical pump according to the invention may be used in all cases where atomizers with propellants, e.g. freons, are now used and, in particular, in the cases where the treated surfaces should be covered with a continuous spray, as with cleaning agents, varnishes, dyes, agents of hair cosmetics, herbicides, antistatic agents, defreezing and antidew agents, and the like. The continuous pump action is suitable also in other applications where a continuous or substantially continuous spray is necessary or desired.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A liquid atomizer adapted to be mounted upon the neck of a bottle, said atomizer having a reciprocating pump for spraying liquid fed from the bottle through a nozzle on the atomizer, said pump having a cylinder, a piston reciprocable therein, housing means to attach the pump to a bottle neck, means including a piston rod reciprocable through sleeve means at the top of the cylinder to drive the piston, liquid conducting means to convey a quantity of liquid from the bottle into and to retain it in the cylinder in a space therein above the piston in each cycle of operation of the pump, and means to conduct liquid from the space in the pump above the piston to the nozzle at each upward stroke of the piston, the means to transfer liquid from the pump to the nozzle comprising a longitudinal channel on the piston rod, the sleeve means having two sets of axially spaced ports therein and functioning as the fixed body of a reciprocable valve, a part secured to the piston rod functioning as the movable valve element of said reciprocable valve, the upper set of ports having radially outer ends adapted to communicate with the interior of the bottle, the lower set of ports having radially inner ends communicating with a lower part of the channel which conducts liquid to the nozzle, and comprising annular obturator means on said part functioning as a movable valve element to close the inner ends of the upper sets of ports and to open the lower set of ports when the piston is in its upper terminal position, to open both sets of ports when it is disposed in an intermediate position between the two sets of ports, and to cut off both sets of ports from communication with the channel supplying liquid to the nozzle when it lies beneath the lower set of ports.

2. An atomizer according to claim 1, wherein the annular obturator is in the form of a sealing cuff piston.

3. An atomizer according to claim 2, wherein the annular obturator is a tube fixedly mounted upon the piston rod.

4. An atomizer according to claim 1, comprising a button means on the top of the piston rod to permit the piston to be thrust downwardly, and a coil compression spring which urges the piston upwardly upon release of the operation button.

5. An atomizer of liquids according to the claim 1, wherein the lower set of parts are recesses formed in the inner wall of the sleeve on the cylinder below the lower edge of the obturator when it is in its upper terminal position.

6. An atomizer of liquids according to claim 1, wherein the piston is in the form of a cuff pointing downwardly and is mounted on the lower end of the piston rod.

7. An atomizer of liquids according to claim 1, wherein the nozzle is mounted on the upper end of the piston rod.

8. A liquid atomizer according to claim 1, wherein said pump is a double-acting reciprocating pump, and wherein the liquid conducting means includes means to convey a quantity of liquid from the bottle into and to retain it in the lower end of the cylinder in the space therein beneath the piston upon the rising of the piston in the cylinder, and means to transfer at least some of said quantity of liquid to and to retain it in the space in the cylinder above the piston during the next downward stroke of the piston.

9. A atomizer for liquids with a double-acting pump according to claim 8, wherein the cylinder contains, in the lower part thereof, a cage formed by a flange and a tube, which carries a conical cuff slid on it and pointing upwardly, the flange containing a connecting hole for joining the space above the cage with the space below the upper edge of the conical cuff, and recesses for a coil compression spring provided in the outer face of the housing means and in the bottom of an operating button on the upper end of the piston rod.

10. An atomizer of liquids with a double-acting pump according to claim 8, wherein the sleeve means on the cylinder is made as a separate element and is telescoped into the upper part of the cylinder.

* * * * *